United States Patent [19]

Crawford

[11] 4,240,785

[45] Dec. 23, 1980

[54] WOOD BURNER

[75] Inventor: John H. Crawford, Corvallis, Oreg.

[73] Assignee: Leading Plywood Corporation, Corvallis, Oreg.

[21] Appl. No.: 17,431

[22] Filed: Mar. 5, 1979

[51] Int. Cl.[3] ..... F23D 15/02

[52] U.S. Cl. ..... 431/352; 60/39.465

[58] Field of Search ..... 126/373, 225, 106, 112; 431/173, 252, 352; 110/243, 244, 234; 34/35, 86; 60/39.46 S, 750, 752, 754–757

[56] References Cited

U.S. PATENT DOCUMENTS

| | | | |
|---|---|---|---|
| 1,618,808 | 2/1927 | Burg | 60/39.46 S |
| 2,517,985 | 8/1950 | Davis | 431/352 X |
| 3,298,418 | 1/1967 | Briggs | 431/352 X |
| 3,368,604 | 2/1968 | Mutchler | 431/352 X |
| 3,463,467 | 8/1969 | Nesbitt | 431/352 X |
| 4,109,459 | 8/1978 | Ekstedt et al. | 431/352 X |

*Primary Examiner*—Carroll B. Dority, Jr.

*Assistant Examiner*—Randall L. Green

*Attorney, Agent, or Firm*—Kolisch, Hartwell & Dickinson

[57] ABSTRACT

Apparatus for burning combustible particles to heat circulated air. The apparatus includes an upright housing containing a removable liner which forms the combustion chamber of the burner, and a perforated, intermediate wall member which forms, with the walls of the housing and the liner, outer and inner gas-receiving spaces, respectively. Air injected into the housing passes from the outer, into the inner gas-receiving space, where the gas is directed, through tuyeres in the liner, into the chamber, substantially tangentially to the wall thereof, producing a gas vortex therein. Particles introduced into the chamber through an upper opening are combusted primarily in the chamber's upper core region with such combustion being supported by, and acting to heat, vortexing gas within the chamber prior to its discharge through a lower chamber opening.

9 Claims, 4 Drawing Figures

WOOD BURNER

BACKGROUND AND SUMMARY

The present invention relates to wood burners, and in particular, to a burner used in burning waste wood to heat circulating air.

It is conventional in wood-processing plants to use waste wood particles as a source of fuel in heating the air circulating within a wood-products dryer. A conventional type of wood burner used in this setting includes a combustion chamber lined with refractory brick, with the walls of the chamber having a fuel-infeed opening through which fuel is introduced, and multiple openings through which air is injected under pressure. During operation, intense heat and turbulence generated near the chamber's brick walls produce excessive wear on the brick. Typically, the brick must be replaced every six months or so, which is both expensive and time consuming.

A more recent type of wood burner includes a combustion chamber which is surrounded by a circulating-water jacket. A number of problems are associated with this type of burner—among them, that a significant portion of the fuel is used in heating the circulating water, and that, absent any provision for confining combustion to the core region of the chamber, the sides of the chamber are subjected to metal-destructive temperatures. Furthermore, the sides of the chamber and the surrounding water jacket form a sealed unit which is relatively expensive to replace.

One important object of the present invention is to provide a wood burner for burning wood particles or the like, wherein combustion is confined primarily to a core region of the combustion chamber, away from the side wall thereof.

Another object of the invention is to provide a wood burner in which the side wall of the combustion chamber is cooled, and circulated air is preheated, as such air passes into the combustion chamber from the outside.

Yet another object of the invention is to provide a wood burner having an easily replaceable liner forming the side wall of the combustion chamber.

The present invention in wood burning apparatus includes an upright housing containing a removable metal liner, the inner wall of which form the side wall of the burner's combustion chamber, and upper and lower open ends of which form fuel-infeed and heated-gas discharge openings, respectively. A top plate detachably secured to the upper end of the housing provides access to the liner, whereby the same may be easily replaced. The liner is provided with a plurality of tuyeres through which pressurized air can be directed into the chamber, substantially tangentially to the inner wall thereof. An upright, perforated intermediate wall disposed between the housing and the liner forms therewith outer and inner gas-receiving spaces, respectively. Air injected into the outer gas-receiving space passes into the inner gas-receiving space, forming therein a layer of pressurized air surrounding the liner. This air is directed into the chamber, through the liner's tuyeres, to set up within the chamber a vortexing gas which is dischargeable through the gas discharge opening.

Also disclosed herein is a fuel dispersion chamber mounted on the burner's top plate and communicating with the fuel-inlet opening. Wood particles injected into this chamber form a vortex therein, whereby the particles are well-dispersed as they descend into the combustion chamber.

These and other objects and features of the present invention will become more fully apparent when read in connection with the following detailed description of a preferred embodiment of the invention and the accompanying drawings.

DRAWINGS

DETAILED DESCRIPTION OF THE INVENTION

Figures 1, 3, 4:
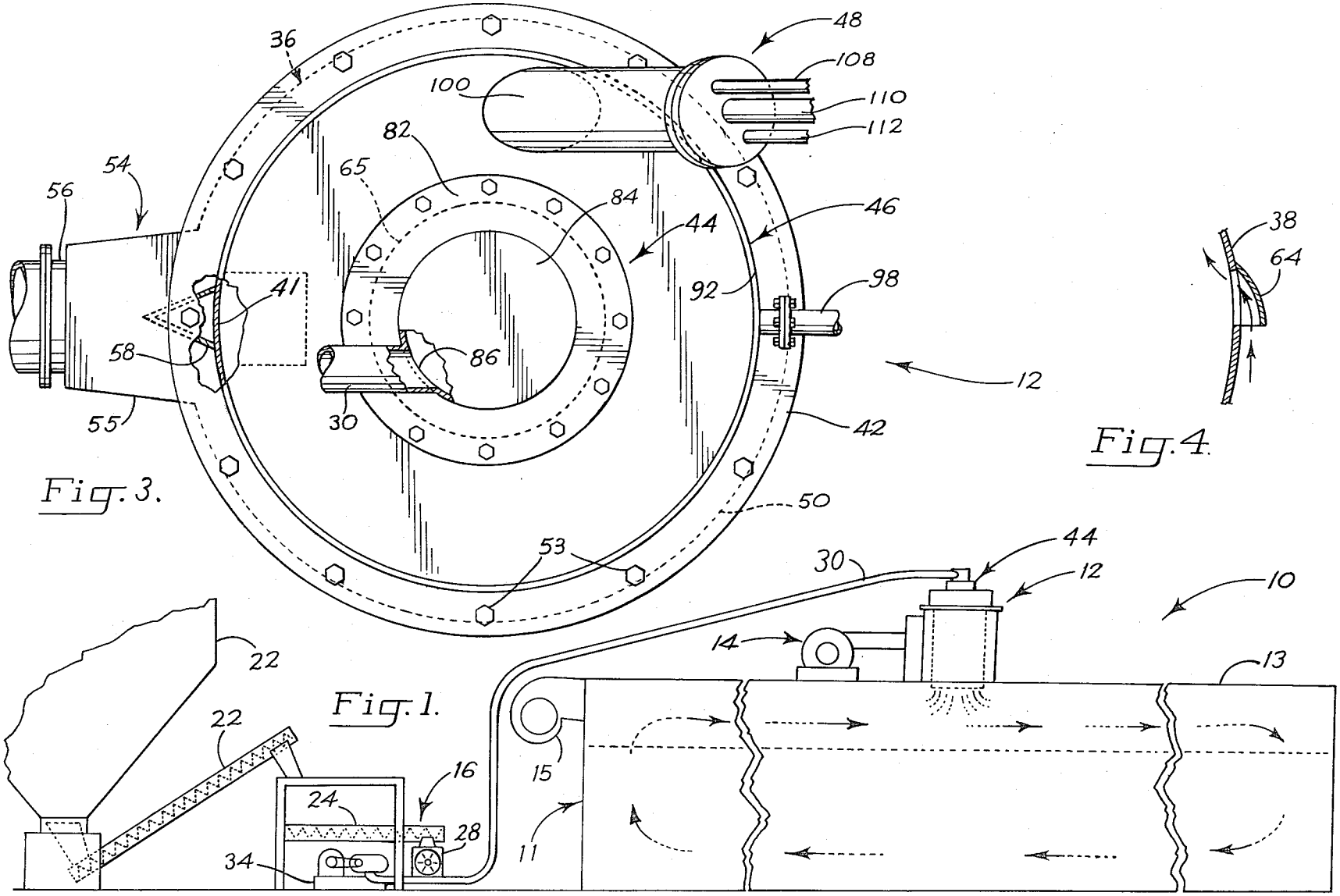
FIG. 1 is a somewhat schematic, side view of a wood-drying system employing the wood burner of the present invention.
FIG. 3 is a top view of the the invention.
FIG. 4 is an enlarged, sectional view of the liner side wall and an associated tuyere, taken generally along the line 4—4 in FIG. 2.

Turning now to the drawings, and to FIG. 1 in particular, there is shown at 10 a wood-drying system employing the wood burner 12 of the present invention. System 10 generally includes a dryer 11 (shown foreshortened in FIG. 1), burner 12 mounted on the dryer roof 13, and a forced-air blower 14, also mounted on roof 13, for injecting air into burner 12, in a manner to be described. A dryer blower 15 is used for circulating heated air through the dryer and the burner in the direction indicated by the arrows in the dryer. Also shown is a fuel feed device 16 for injecting combustible wood particles into the wood burner, in a manner to be described. System 16 is supplied by conveyor 20 from a storage hopper, shown fragmentarily at 22, in which is stored a quantity of combustible particles such as sawdust or powdered wood.

System 16 includes an infeed conveyor 24 which is fed by conveyor 20, and a variable-speed auger 28 for admitting preselected quantities of particles from conveyor 24 to a fuel-infeed conduit 30. A forced-air blower 34, connected to conduit 30 upstream of auger 28, functions to blow combustible particles in the conduit into the wood burner.

In the operation of system 10, air is discharged from the burner at a temperature of between 1200° F. and 1500° F., and dryer-circulated air is returned at a temperature of about 175° F. The temperature at the drying station within the dryer, which is typically about 400° F., is monitored by heat sensors (not shown). Information from these sensors is relayed to a hydraulic motor (not shown) controlling auger 28. Accordingly, fuel (wood) particles are supplied to burner 12 at a rate which maintains the sensor-monitored temperature within the dryer at a preselected level.

Figure 2:
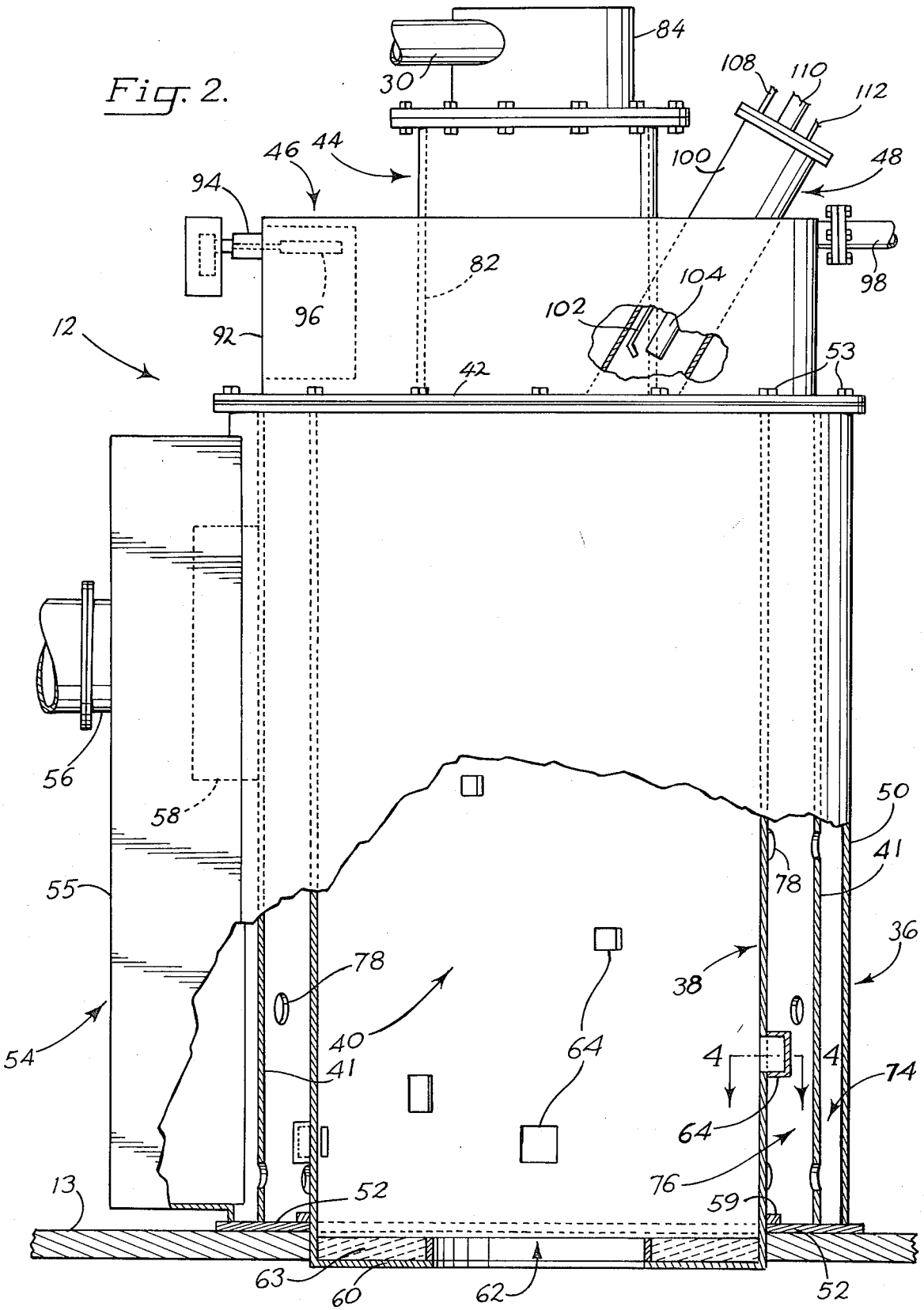
FIG. 2 is an enlarged, side view of the wood burner of the present invention, with a lower portion broken away to show the construction of the interior region of the burner.

Looking at FIGS. 2 and 3, burner 12 generally includes an upright, cylindrical housing 36, a cylindrical liner 38 forming the combustion chamber 40 of the burner, and a cylindrical intermediate wall member 41 disposed between the housing and the liner. The three just-mentioned upright structures are covered by a top plate 42 on which is mounted, centrally thereof, a fuel-infeed assembly 44 and a water bath 46. An ignition assembly 48 attached to plate 42, and extending therethrough, into the combustion chamber, is used to initiate and sustain combustion within chamber 40, as will be described.

Considering the construction of burner 12 in greater detail, and with continued reference to FIGS. 2 and 3, housing 36 includes an upright, cylindrical wall portion 50 to which are attached, at the upper and lower ends thereof, upper and lower annular flanges, respectively, such as the lower flange 52 shown at the bottom in FIG. 2. The just-mentioned upper flange is threaded at spaced-apart radial intervals for receiving bolts, such as bolts 53, used in securing plate 42 to the housing. The lower flange is securable to the upper surface of dryer roof 13.

Housing 36 communicates, at its left side in FIGS. 2 and 3, with an elongate baffle 54 extending substantially along the length of the housing. Baffle 54 includes a cover 55 and air inlet means including a port 56 extending through the cover and communicating with blower 14 (FIG. 1). Housed within cover 55 is a V-shaped diverter 58 which is attached, along its right edges in FIG. 3, to the outer face of wall member 41, as seen in FIGS. 2 and 3. Diverter 58 functions to direct forced air from blower 14 in opposite directions within the space between housing 36 and member 41, for a purpose to be described.

Liner 38 includes a metal cylindrical sleeve which is dimensioned to extend through a suitable opening in roof 13 when the top edge of the liner is aligned with the upper edge of housing 36, as seen in FIG. 2. An annular lip 59 attached to the liner, adjacent its lower end in FIG. 2, abuts flange 52, as shown, to support the liner in the just-mentioned position. The liner has formed at its upper and lower ends, upper and lower annular flanges, respectively, such as the lower flange 60 seen in FIG. 2. The lower flange defines a lower heated-gas discharge opening 62 through which heated gas is discharged from the combustion chamber. This flange is covered by a suitable fire brick material, indicated at 63, in FIG. 2. The just-mentioned upper flange forms an opening (shown by the dashed line at 65 in FIG. 3) which communicates with the lower portion of feed assembly 44, and which serves as a fuel-infeed opening.

Spaced radially and longitudinally along the upright portion of liner 38 are plural vents, or tuyeres, such as those shown at 64. As seen best in FIG. 4, each tuyere is formed to act as an air scoop for directing air passing into the combustion chamber substantially tangentially to the inner wall thereof, as shown by the arrows in FIG. 4. Collectively, the tuyeres provide vent means for admitting air into the combustion chamber in a counter-clockwise direction, as viewed from the top in FIG. 3. As seen in FIG. 2, the size of the tuyere openings generally increases in a top-to-bottom direction, providing greater vent in-flow capacity on progressing toward the lower end of the liner.

Looking at FIG. 2, wall member 41 is held within housing 36 by attachment of the lower and upper edges of member 41 to the lower and upper housing flanges, respectively. This wall member forms, with the adjacent walls of housing 36 and liner 38, outer and inner gas-receiving spaces 74, 76, respectively. A plurality of radially and axially spaced perforations in the wall member, such as perforations 78, allow passage of gas between the two just-mentioned spaces.

Particle infeed assembly 44 includes a dispersion chamber formed by a lower, cylindrical, larger-diameter section 82 and an upper, hat-shaped, smaller-diameter section 84. Section 82 is attached, at its lower open end, to plate 42, about a central opening therein, which opening corresponds radially to the above-mentioned fuel-infeed opening indicated by the dashed line 65 in FIG. 3. Section 82 is attached, at its open, upper end, to the open, lower end of section 84. As seen best in FIG. 3, infeed conduit 30 communicates with the interior of section 84 substantially tangentially to the side wall thereof, through port means including a port 86 (FIG. 3).

Water bath 46 is formed by an open-top cylindrical member 92 which is sealingly attached at its lower end to top plate 42. Attached to the left side of the member 92 in FIG. 2 is a conventional water-infeed valve 94, the condition of which is controlled by a float device, indicated here at 96, which is responsive to the water level within the water bath, to maintain a substantially constant water level within the bath. Attached to the right side of member 92 in FIG. 2 is a drain port 98.

Completing the description of the present invention, ignition assembly 48 includes a housing 100 mounted on plate 42, as seen in FIGS. 2 and 3, and, containing therein, as seen in FIG. 2, an ignition system, or ignition means, which includes a pilot burner 102, a main gas burner 104 and an electrical spark-igniter (not shown) for lighting burner 102. Gas and electric lines supplying burners 102, 104, and the spark igniter, are connectable thereto at supply ports 108, 110 and 112, respectively. Also included in the ignition system, but not shown, is a temperature sensor positioned adjacent burner 102, for detecting the presence of flame produced by this burner. The just-mentioned sensor is operatively connected to a valve controlling the supply of gas to burner 104, for a purpose to be described.

Describing the operation of the wood burner, to initiate operation, the ignition system just described is activated by lighting pilot burner 102 with a spark provided by the pilot igniter. The flame from the pilot light is sensed by the above-mentioned temperature sensor which, at a suitable temperature, operates, through suitable relays, to open the valve supplying burner 104, which is then ignited by burner 102.

With reference to FIG. 1, combustible material such as wood particles, which have been hammered to a fine, powder-like dust, are injected into the upper section of assembly 44 by fuelinfeed system 16, in the manner described above. The powdered fuel, injected into section 84 through the side thereof, forms a vortex therein as it descends into section 82. Upon reaching the latter section, the particle vortex expands, further dispersing the particles before their entry into chamber 40.

According to one important object of the present invention, fuel combustion within chamber 40 is largely confined to the upper, core region of the chamber, away from the side wall of liner 38. The novel feature of the present invention by which this result is achieved can now be appreciated. With reference to FIG. 1, circulating air from dryer 11 is injected, by blower 14, into the left side of housing 36, through port 56. This air is directed, by diverter 58, in opposed radial directions within outer, gas-receiving space 74, substantially filling this space. The air within this space flows through perforations 78 in wall member 41, into inner, gas-receiving space 76, forming therein an annular layer of pressurized gas surrounding liner 38.

Pressurized gas in space 76 is directed, through tuyeres 64, into the interior of chamber 40, forming therein a column of gas which is rotating in a counter-clockwise direction when viewed from the top in FIG. 3. Due to the greater vent inflow capacity toward the lower portion of the liner, described above, the gas forms a spiraling vortex within the chamber. The vortexing gas within chamber 40, which both supports the particle combustion and is heated thereby, is vented into dryer 11, through discharge opening 62.

Combustible wood particles, which enter the top of chamber 40 in a highly dispersed form, as described above, descend into the vortexing mass of air within chamber 40, and become incorporated therein. During the initial operation of the wood burner, the flame from burner 104 serves to ignite the vortexing particles in the upper portion of the chamber, with the heat of combustion of the particles serving the ignite the remainder of the particles within the chamber. It is noted here that once combustion within chamber 40 has been initiated, the heat produced thereby is sufficient to sustain combustion without burner 104. However, it is customary to use the burner during operation to ensure that an explosive build-up of uncombusted particles within the chamber does not occur.

From the foregoing, it can be appreciated how one important object of the invention—to confine fuel combustion substantially within the core region of the combustion chamber, away from the side wall thereof—is met. In particular, because combustion is supported by the vortexing gas within the chamber, the most intense heat of combustion occurs within the most concentrated portion of the vortex—at the upper core region of the chamber. It is noted here that the gas vortex, by maintaining the combustible particles dispersed and rapidly moving, increases the extent of particle combustion, thus reducing the amount of residue in the heated gas exiting from the burner.

It can also be appreciated that the double jacket of circulating air surrounding liner 38, which air feeds the vortex within the combustion chamber, also serves to carry heat away from the liner side wall and into the chamber. In addition, in cooling the liner side wall, the circulated air becomes somewhat preheated before entering chamber 40, thus increasing the overall efficiency of the burner.

Heat is carried away from the upper portion of chamber 40 by heat conduction through plate 42 into water bath 46. During burner operation, the rate of heat conduction across plate 42 is sufficient to cause rapid boiling of water within the bath. Float device 96 maintains the water within jacket 92 at a desired level.

Finally, it can be appreciated from the foregoing how the construction of the present invention allows for rapid and easy replacement of liner 38. Simply by detaching plate 42—and attached water bath 46 and particle feed assembly 44—from housing 36, the liner can be removed and replaced.

A wood burner which is designed to promote substantially complete combustion of particularized particles, with the heat of combustion being contained largely in the core region of the combustion chamber, away from the side wall thereof, has thus been disclosed. Various modifications and changes may be made in the above-described wood burner without departing from the spirit thereof.

It is claimed and desired to secure by Letters Patent:

1. Apparatus for burning combustible particles to heat circulated air, said apparatus comprising an upright housing, an upright, substantially cylindrical liner disposed within said housing, forming a combustion chamber having a fuel-infeed opening at its upper end and a heated gas discharge opening at its lower end, an upright, intermediate wall member disposed between said housing and said liner, said wall member forming, with said housing and said liner, outer and inner gas-receiving spaces, respectively, said well member having perforations allowing gas flow between said spaces, air inlet means through which air may be injected into said outer space, with such air flowing through said perforations into said inner space, forming therein a layer of pressurized air surrounding said liner, vent means in said liner for directing such pressurized air into the combustion chamber, substantially tangentially to the inner wall thereof, thus to establish within said chamber a vortexing gas dischargeable through said discharge opening, particle dispersion means for supplying such particles, in dispersed form, into an upper portion of said chamber, and ignition means disposed adjacent said upper portion for initiating combustion of said particles therein, such combustion being supported by, and acting to heat, such vortexing gas within said chamber.

2. The apparatus of claim 1 which further comprises a top plate detachably mounted on said housing, and wherein said liner is removable from said housing when said top plate is detached therefrom.

3. The apparatus of claim 2, wherein said plate is heat conductive, and said apparatus further includes a liquid holding container mounted on said top plate for dissipating heat therefrom.

4. The apparatus of claim 1 or 2, wherein said vent means includes a plurality of tuyeres spaced radially and axially on said liner.

5. The apparatus of claim 1, wherein said particle dispersion means includes an upright dispersion chamber communicating at its lower end with said combustion chamber, and port means through which such particles may be injected into said dispersion chamber, to create a vortex of particles therein.

6. The apparatus of claim 5, wherein said dispersion chamber includes an upper, smaller-diameter cylindrical section having said port means formed therein, and a lower, larger-diameter cylindrical section which communicates, at its the upper and lower open ends, with said smaller-diameter section and said combustion chamber, respectively.

7. Apparatus for burning powdered wood particles or the like to heat circulated air, said apparatus comprising an upright housing, a top plate detachably mounted on said housing, an upright, substantially cylindrical liner disposed within said housing, forming a combustion chamber having a fuel-infeed opening at its upper end and a heated-gas discharge opening at its lower end, said liner being removable from said housing when said top plate is detached therefrom, an upright, intermediate wall member disposed between said housing and said liner, said member forming, with said housing and said liner, outer and inner gas-receiving spaces, respectively, said member having perforations allowing gas flow between said spaces, air inlet means through which air may be injected into said outer space, with such air flowing through said perforations into said inner space, forming therein a layer of pressurized air surrounding said liner, a plurality of tuyeres radially and axially spaced on said liner for directing such pressurized air into said chamber, substantially tangentially to the inner wall thereof, thus to establish within said chamber a vortexing gas dischargeable through said discharge opening, an upright particle dispersion chamber mounted on said top plate and communicating at its lower end with the upper end of said chamber, said dispersion chamber having a port through which such particles may be injected, substantially tangentially to the inner wall of the dispersion chamber, creating a vortex of such particles therein, and ignition means disposed adjacent said upper combustion chamber end for initiating combustion of such particles within said combustion chamber, such combustion being supported by, and acting to heat, such vortexing gas therein.

8. The apparatus of claim 7, wherein said tuyeres are so arranged and dimensioned that vent in-flow capacity generally increases in a top-to-bottom direction along said liner.

9. The apparatus of claim 7, wherein said top plate is heat conductive, and which further includes a water bath mounted on said top plate for dissipating heat therefrom.

* * * * *